US006779479B1

(12) United States Patent
Agius

(10) Patent No.: US 6,779,479 B1
(45) Date of Patent: Aug. 24, 2004

(54) REACH ARM FOR MAIL SIGNAL APPARATUS

(76) Inventor: Theodore Agius, 1032 Shelby Lynn Ct., Sugar Hill, GA (US) 30518

( * ) Notice: Subject to any disclaimer, the term of this patent is extended or adjusted under 35 U.S.C. 154(b) by 302 days.

(21) Appl. No.: 09/943,311

(22) Filed: Aug. 31, 2001

(51) Int. Cl.[7] ..... G09F 11/00
(52) U.S. Cl. ..... 116/284; 116/303
(58) Field of Search ..... 116/303, 305, 116/333, 294, 297, 281, 282, 284, 285, 173, 175; 232/35

(56) References Cited

U.S. PATENT DOCUMENTS

| | | | | | |
|---|---|---|---|---|---|
| 844,435 | A | * | 2/1907 | Wolf | 232/35 |
| 1,521,397 | A | * | 12/1924 | Scott | 232/35 |
| 1,927,736 | A | * | 9/1933 | Davis et al. | 232/35 |
| 2,687,846 | A | * | 8/1954 | Chrisman | 232/35 |
| 2,698,712 | A | * | 1/1955 | Kreitlow | 232/35 |
| 2,782,983 | A | * | 2/1957 | Cyphers | 232/35 |
| 2,905,378 | A | * | 9/1959 | Cox et al. | 232/35 |
| 2,939,629 | A | * | 6/1960 | Barkdoll | 232/35 |
| 3,680,524 | A | * | 8/1972 | Korinek et al. | 232/35 |
| 4,202,486 | A | * | 5/1980 | Tipsword | 232/35 |
| 4,570,846 | A | * | 2/1986 | Morgrey | 232/35 |
| 4,883,223 | A | * | 11/1989 | Taniguchi | 232/35 |
| 6,293,461 | B1 | * | 9/2001 | Rivers, Sr. | 232/35 |

* cited by examiner

*Primary Examiner*—Christopher W. Fulton
*Assistant Examiner*—Travis Reis

(57) ABSTRACT

A reach arm (13) with opening to facilitate slide with arm/door bolt (24)protrudes out from mail signal apparatus when door is opened and after it is closed. Pushing protruding reach arm lowers/resets signal apparatus.

1 Claim, 3 Drawing Sheets

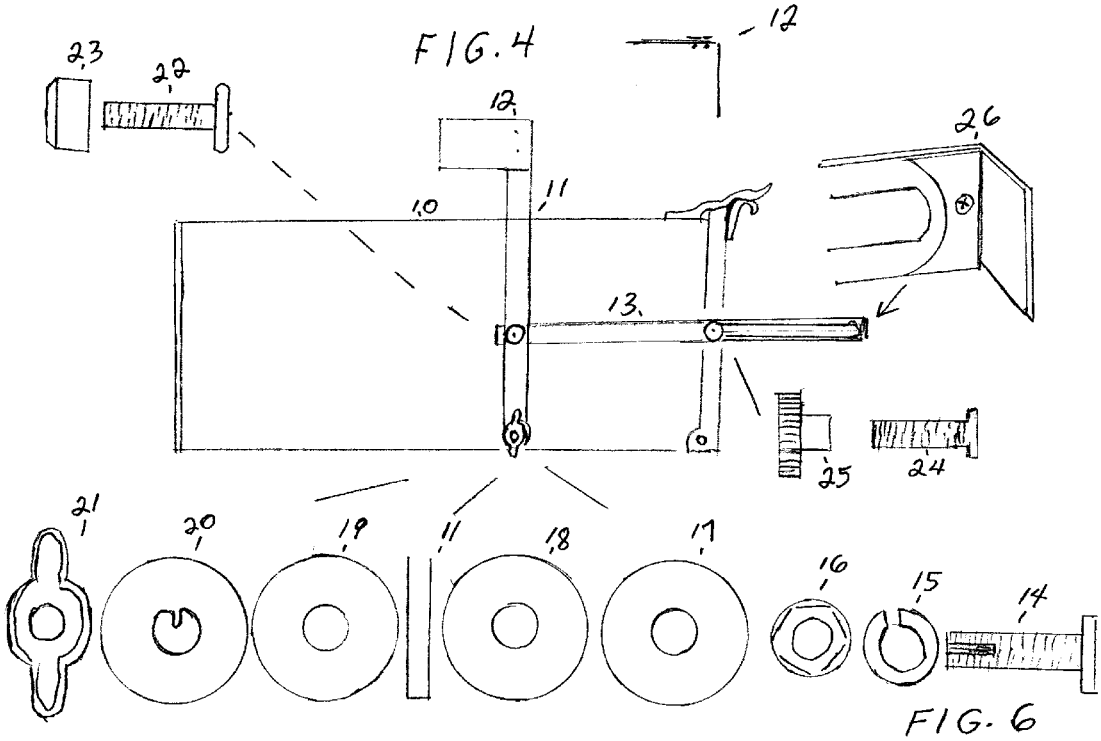
FIG. 4
FIG. 6
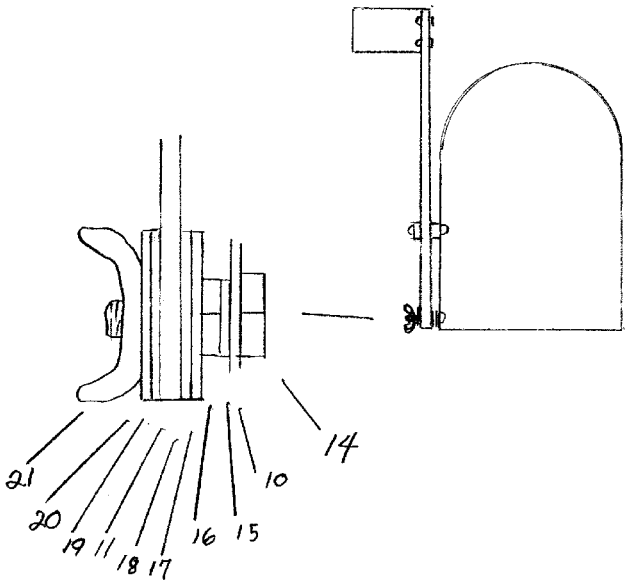
FIG. 5

REACH ARM FOR MAIL SIGNAL APPARATUS

CROSS-REFERENCE TO RELATED APPLICATIONS

Not applicable.

BACKGROUND—FIELD OF INVENTION

This invention relates to mailbox signal indicator apparatuses.

BACKGROUND—DESCRIPTION OF PRIOR ART

As far back as U.S. Pat. No. 2,092,501 to Sandifur (1936) there have been attempts to create a signal system to be connected to a mailbox that would indicate when mail arrives.

Inventors created several types of such signal systems that through a simple mechanism raised a signal (i.e., a flag or similar signal) when the mailbox door was opened and would remain up after the mailbox was closed. This signal would indicate to the owner only that the mail carrier had come and gone. The owner would then know to go to the mailbox and check for mail. Then the owner would manually lower the signal flag.

The problem with this set-up is that the signal flag goes up regardless of whether any mail arrives. For instance, if the owner was sending a letter, the mail carrier would open the mailbox to retrieve the letter at the same time raising the signal flag. However, if the mail carrier had no new mail to deliver to the owner, the owner would make an unnecessary trip to the mail box.

SUMMARY

The present invention includes the basic mechanisms of prior art in addition to an arm mechanism that protrudes out from the front of the box. This is the Reach Arm.

OBJECTS AND ADVANTAGES

The present invention contains several objects and advantages over the prior art. For example, my invention provides a signal apparatus for mailboxes that will permit the mail carrier in rural and residential districts to signal to the owner that the mail carrier has not only passed through, but that he or she has actually delivered mail.

For example, if the mail carrier retrieves mail but has no mail to deliver, he or she can simply push the reach arm that conveniently protrudes out toward him and the signal flag will go down. This will indicate to the owner that the mail has been picked up (because the traditional red flag is down).

The goal of prior art was ultimately to save people trips to the mailbox. The present invention, however, will accomplish that goal to a greater extent.

Further objects and advantages are that the reach arm makes it convenient for mail carriers or others retrieving mail from their automobiles as there is no reaching to lower the signal flag.

Both the traditional red flag and the blue signal flag can be seen in all directions. (See FIG. 3).

DRAWING FIGURES

FIG. 4 shows all parts of the kit including nuts, bolt, and washer assembly.

FIG. 5 shows the front view of the mailbox.

FIG. 6 shows the side view illustrating the main axle assembly, bolts, washers and nuts.

REFERENCE NUMERALS IN DRAWINGS

Figure 1:
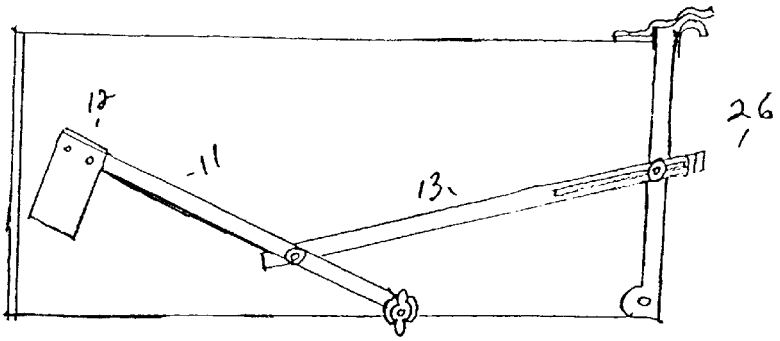
FIGS. 1–3 show the signal mechanism.

| | | | |
|---|---|---|---|
| 10 | mailbox | 11 | mast |
| 12 | blue signal flag | 13 | reach arm |
| 14 | main bolt w/notch | 15 | lock washer |
| 16 | Nut | 17 | metal washer |
| 18 | plastic washer | 19 | plastic washer |
| 20 | metal washer w/notch | 21 | wing nut |
| 22 | arm/mast bolt | 23 | lock nut |
| 24 | arm/door bolt | 25 | slide nut |
| 26 | plate | 27 | door |
| 28 | traditional flag | 29 | nuts and bolts |

DESCRIPTION—MAIN EMBODIMENT

FIG. 6 illustrates the main bolt assembly located at the bottom of the mast 11 measuring 7⅛ inches from the front door of the box. The main bolt w/notch 14 goes through the bottom of the mail box and protrudes outward through the other side of the metal sheet making up the left side of the box.

The arm/door bolt 24 goes through a hole in the side of the box to be drilled 4 inches from the bottom of the mail box.

The arm/mast bolt 22 and the lock nut 23 fasten the mast 11 to the reach arm 13. When the flag is up as in FIG. 4 the arm is to be parallel with the ground and arm/mast bolt 22 should be 4 inches up the mast from main bolt w/notch 14.

FIG. 6 illustrates main bolt assembly.

FIG. 4 illustrates arm/mast bolt assembly.

FIG. 5 illustrates arm/door bolt assembly.

OPERATION—MAIN EMBODIMENT

Figure 2:
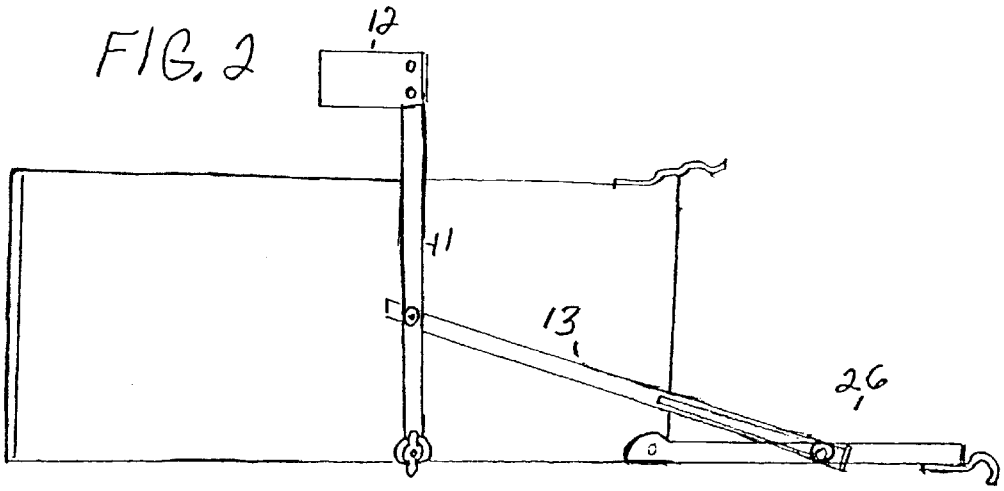
Figure 3:
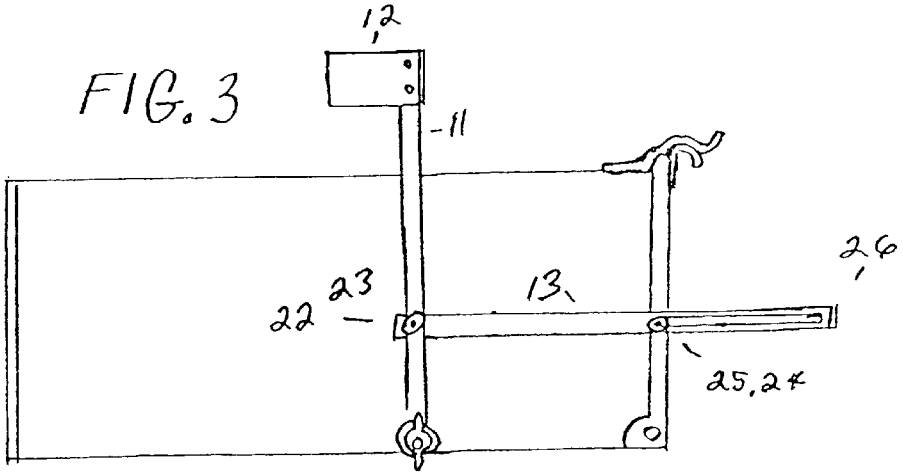
Figure 7:
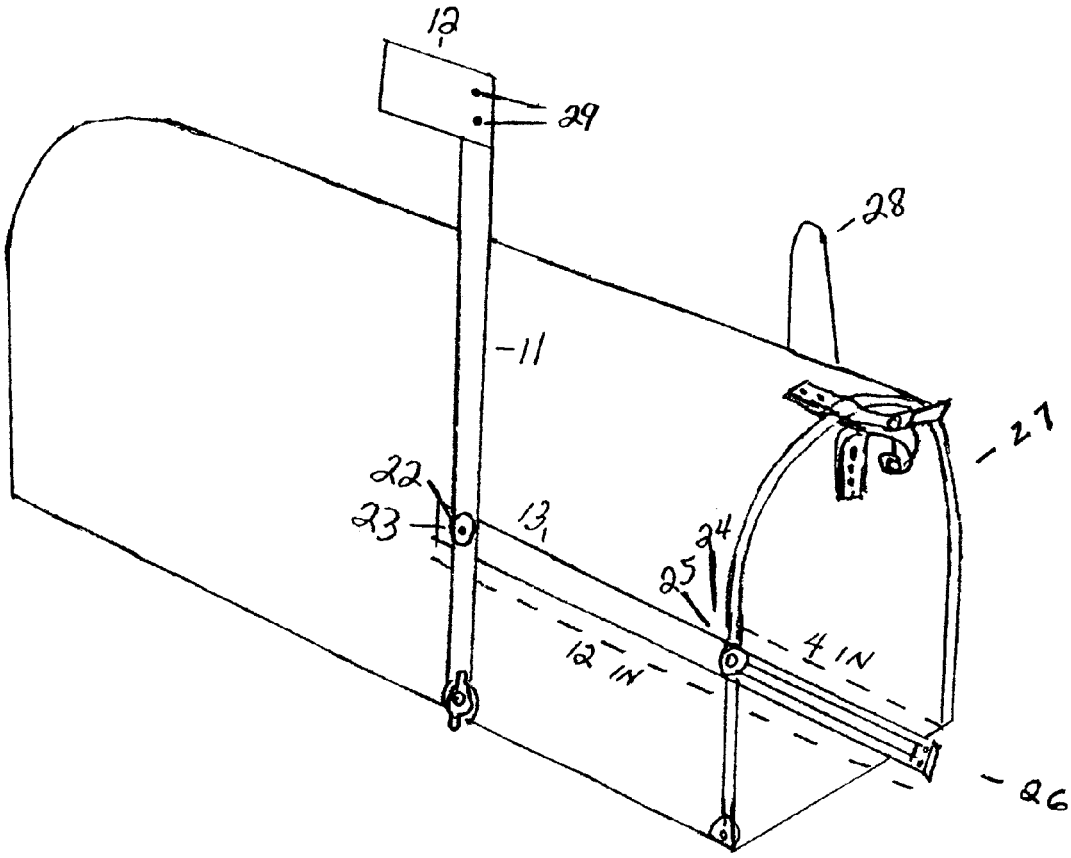
FIG. 7 shows the side view of the mailbox illustrating the length of the shaft and its position in relation to the traditional flag on the opposite side of the mailbox.

The signal flag 12 is down as in FIG. 1. When the mail box door is opened the signal flag 12 rises as it is pulled by the reach arm 13. As in FIG. 2 the door is open and the signal flag 12 is up. As the door is closed arm/door bolt assembly slides along the slide on the reach arm 13 and the signal flag 12 remains up as in FIG. 3. The reach arm 13 protrudes out of the front of the box.

CONCLUSION, RAMIFICATIONS, AND SCOPE

As previously shown the protruding reach arm greatly improves the signaling system because:

- it allows the mail carrier to easily signal whether he put mail in the mail box or not.
- it allows the owner or mail carrier to easily lower the signal flag if picking up mail from an automobile.
- A message on the protruding reach arm reading: "mail carrier, please push if no mail was delivered" clearly instructs the mail carrier to push the arm if no mail is delivered.

The reach arm allows the owner to know exactly what has taken place at his mailbox at a given time. Many people in rural areas, with long driveways, or those who live in harsh climates have had the inconvenience of not knowing the status of the mail delivery. My signaling system with protruding reach arm will allow the owners to know the status of the mail delivery with minimal required participation from the mail delivery carrier.

I claim:

1. On a mail box with a traditional signal indicator apparatus, including a mast, the improvement is an extended 12 inch shaft (13) that protrudes four inches beyond the mail box door wherein the back side of said shaft is attached to said mast (11) by an arm/mast bolt (22) and a lock nut (23) and slides along a slide nut (25) and an arm/door bolt (24) connected to the door (27); the groove on the front side of said shaft slides along an extension on the slide nut which protrudes outward and acts as a slide for said shaft; wherein said shaft and mast, with signal flag (12) attached by two nuts and bolts (29), are located on the opposite side of the mail box where the traditional signal indicator apparatus is located.

* * * * *